United States Patent [19]

Harris

[11] Patent Number: 4,873,114

[45] Date of Patent: Oct. 10, 1989

[54] COATING EXPENDABLE SUBSTRATES WHICH CONTACT MOLTEN METAL

[75] Inventor: Jeffrey A. Harris, West Bromwich, United Kingdom

[73] Assignee: Foseco International Limited, Birmingham, England

[21] Appl. No.: 630,238

[22] Filed: Jul. 12, 1984

Related U.S. Application Data

[63] Continuation of Ser. No. 201,481, Jul. 9, 1980, abandoned.

[30] Foreign Application Priority Data

Jan. 21, 1980 [GB] United Kingdom ..... 8000013

[51] Int. Cl.[4] ..... B05D 1/04

[52] U.S. Cl. ..... 427/27; 164/21; 164/24; 427/134

[58] Field of Search ..... 427/27, 134, 133; 164/21, 24

[56] References Cited

U.S. PATENT DOCUMENTS 4,039,697 8/1977 Isawa ..... 427/27

FOREIGN PATENT DOCUMENTS 151131 6/1950 Australia ..... 427/27
2753104 9/1978 Fed. Rep. of Germany .
45-5369 2/1970 Japan .
1069423 5/1967 United Kingdom .
1475069 6/1971 United Kingdom .
1310049 3/1973 United Kingdom .

*Primary Examiner*—Sam Silverberg
*Attorney, Agent, or Firm*—Cushman, Darby & Cushman

[57] ABSTRACT

An expendable substrate which in use contacts molten metal, for example a foundry mould or core or ladle lining, is coated with a coherent layer of refractory particles by tribo-electrically charging refractory particles coated with an organic binder, the coated particles having an electrical resistivity of at least $10^{10}$ ohm. cm. at 10kv, earthing the substate and bringing the charged particles into contact with the earthed substrate. Suitable binders are thermoplastic resins, thermosetting resins and waxes and the quantity of binder in the binder coated particles is usually less than 10% by weight.

5 Claims, No Drawings

COATING EXPENDABLE SUBSTRATES WHICH CONTACT MOLTEN METAL

This is a continuation of application Ser. No. 201,481, filed July 9, 1980 now abandoned.

The invention relates to an improved way of applying coatings to expendable substrates which in use contact molten metal, for example during casting. Typically such substrates are formed of mixtures of refractory materials and binders which have an electrical conductivity which is relatively much lower than that of metal, e.g. having resistance values of the order of $10^{10}$ at 10 kv. Such substrates include foundry moulds, foundry cores, ladle linings, etc. These substrates are used one or a few times when casting metal and they are then discarded, although they may be broken up and the refractory materials of which they are made then recovered for further industrial use. The invention is especially applicable to the application of coatings to expendable substrates such as moulds or cores used in the foundry industry which are given a coating in order to improve their resistance to metal penetration and also generally to improve the surface finish of the casting formed in the mould or against the core.

An object of the invention is to provide an improved method of applying a coating to an expendable substrate without the need to use a liquid carrier for such coating and with improved speed and economy.

According to the invention a method of coating an expendable substrate which in use contacts molten metal comprises (i) tribo-electrically charging particles of refractory material coated with an organic binder, the coated particles having an electrical resistivity of at least $10^{10}$ ohm. cm. at 10 kv (ii) earthing the expendable substrate and (iii) bringing the charged particles into contact with the earthed substrate so as to coat the substrate with a coherent layer of the particles.

If the substrate has too high an electrical resistivity the charge carried by the coated particles builds up on the substrate and further powder is repelled.

The limit of resistivity of the substrate for satisfactory use is dependent on the rate of coating deposition required, and the design of the application device, but is approximately $10^9$ ohm. cm. at 10 kv, preferably less than $10^8$ ohm. cm. at 10 kv.

The expendable substrate may be for example an inorganic, non-metallic material such as a foundry sand mould or core, or a lining in a molten metal container such as a ladle or a tundish.

Sand moulds and cores are made by various processes most of which involve bonding together particles of refractory material, such as silica sand, with a binder. While most types of binder system produce moulds or cores which may be coated by the process of the invention not all are suitable because they produce a substrate of too high an electrical resistivity. An example of a substrate which is unsuitable is linseed-oil bonded sand which has an electrical resistivity of $10^{12}$ ohm. cm. at 10 kv. Examples of bonded sands which form suitable substrates are those bonded with sodium silicate or an acid catalysed resol phenol-formaldehyde resin, which have electrical resistivities of $2.5\times10^6$ ohm. cm. at 10 kv and $6\times10^8$ ohm. cm. at 10 kv respectively.

In order that the particles of refractory material which are to be coated on to the substrate may be tribo-electrically charged satisfactorily it is essential that substantially all of the particles are wholly coated with a binder and that the coated particles have an electrical resistivity of at least $10^{10}$ ohm. cm. at 10 kv, and preferably $10^{12}$ ohm. cm. at 10 kv.

However, since the coating which is applied to the expendable substrate is to be used in contact with molten metal the binder content must be kept as low as possible commensurate with the need to achieve the required electrical resistivity, and sufficient strength to keep the coating intact once it has been applied. The quantity of binder present in the binder coated particles will not therefore usually exceed 10% by weight.

The binder coated particles of the invention can be distinguished readily from the materials which are already known to be applied to substrates by electrostatic processes. Paints such as those which are applied to car bodies by electrostatic spraying consist of a matrix forming a high proportion of the paint (e.g. 60% by weight) of an organic binder and,dispersed in the binder,particles of paint filler material. In British Patent No. 1 475 069 which describes a process for manufacturing a foundry mould or core by electrostatically depositing a layer of refractory material on a pattern or a core box the refractory material is used with a binder system, for example an epoxy resin and a hardener for the resin, but all three components are present as discrete particles.

Neither of these two types of material would be suitable for use in the process of the invention, the former contains too much organic binder for use in contact with molten metal, and the latter would not have the required electrical resistivity to be capable of being charged tribo-electrically.

Depending on the density of the particular material the size of the particles of refractory material may have a diameter from about 0.5 microns to about 80 microns. If the particle size is too large the gravitational forces become significant when the coating medium is applied by spraying and if the particle size is too small it is not possible to coat them with an appropriate amount of binder. In the case of zircon particles these preferably have an average particle diameter of about 10 microns.

Examples of suitable refractory materials include for example zircon, graphite, silica, chromite and alumina.

The binder may be for example a thermoplastic or a thermosetting resin or a wax. Examples of suitable resins include epoxy resins, polyester resins and polyurethane resins. Vegetable, mineral, animal or synthetic waxes may be used. Examples of suitable waxes include montan wax and carnauba wax.

Achievement of the required electrical resistivity in the binder coated particles, and hence ability to apply the particles by the process of the invention is dependent on the refractory material, the binder,the amount of binder used and the way the binder is applied, and in some instances on the apparatus used to tribo-electrically charge the particles.

In some instances using a particular combination of refractory material and binder it may be possible to convert an unsuitable material into a suitable material simply by increasing the binder content slightly. In any event the suitability of a particular coated material can readily be determined by preliminary experimentation.

Tribo-electric charging is the name given to the phenomenon of charging particles with an electric charge solely by means of friction. In practice particles of a powder are passed through a suitable charging tube together with a gaseous carrier, typically air, and the stream emerging from the nozzle is directed at an article to be coated.

Spray equipment which utilises tribo-electric charging of coating particles is commercially available, one example being the MINDON (trade mark) Airstatic powder spray equipment.

It has been found that using the method of this invention it is possible to apply a solid coating medium to a sand or mould core without the use of hazardous and inconvenient electrical equipment associated with other electrostatic processes and also without the use of liquid carriers usually associated with coating compositions. In addition it is easier to build up coating thickness to a desired level and also to coat articles of intricate shape.

The invention includes the method as described and moulds and cores when coated by the method.

The invention is illustrated by the following Examples.

EXAMPLE 1

A polyester having a softening point of 91°-92° C. was dissolved in acetone and zircon flour of 40 micron average particle size was added to form a slurry. Water was added with stirring until the polyester was thrown out of solution to coat the zircon particles. These were then recovered by vacuum filtration and oven dried. Ignition loss at 1000° C. showed that about 3% of the weight of the coated zircon particles was the polyester.

The suitability of the polyester coated zircon particles for application by tribo-electrostatic spraying was assessed by passage through a tribo gun and then spraying on to a flat metal plate. The particles had a resistivity at 10 kv of $5\times10^{13}$ ohm. cm. and stuck to the plate.

EXAMPLE 2

Zircon flour, 10 parts, water, 20 parts, montan wax and an emulsifier 10. of the amount required to emulsify the montan wax, were heated to about 90° C. with stirring to melt the wax. The mix was allowed to cool while stirring following which the wax coated zircon particles were recovered by vacuum filtration. Ignition loss at 1000° C. was 3.4% by weight.

The suitability of the wax coated zircon particles for application by tribo-electrostatic spraying was assessed by passage through a tribo gun and then spraying on to a flat metal plate. The particles had a resistivity at 10 kv of $5\times10^{13}$ ohm. cm. and adhered to the plate.

EXAMPLE 3

Standard compression-strength test cores were made from two sand compostions and used as expendable substrates. Each composition consisted of sand together with a suitable binder; in one case the binder was a sodium silicate hardened by an ester and in the other case a resin binder was used.

A solution of anhydride cured epoxy resin in acetone was sprayed on to a fluidised bed of zircon flour in order to form a powder of the zircon coated with the resin in a ratio of 97 weight parts zircon to 3 weight parts resin. The dry powder was then supplied together with a stream of air to the inlet of a tribo-charging spray gun. The powder was passed through the gun and then sprayed onto the surface of each of the cores mentioned above, while the latter stood on an earthed platform. The cores were then warmed to melt the resin to form a complete coating over the cores which on inspection was found to be coherent and about 1mm thick. When molten iron was poured against the cores, castings of excellent surface finish and free of defects were formed. The use of the gun was especially easy and safe.

EXAMPLE 4

Carbon dioxide gas hardened sodium silicate bonded sand cores were tribo-electrostatically sprayed with resol phenol-formaldehyde resin coated zircon particles using a tribo gun as described in Example 3.

The resol phenol-formaldehyde resin coated particles were produced by the method described in Example 1 but using isopropanol instead of acetone. The binder contents of two different samples,as determined by loss on ignition on the coated zircon particles,were 2.2% and 3.0% by weight.

Both samples produced abrasion resistant coating layers on the sand cores.

What is claimed is:

1. In a method of casting molten metal using a foundry sand mould or core substrate for the cast molten metal, the improvement which comprises:

(a) preparing a mould or core substrate from sand and binder so that the substrate has a resistivity of less than $10^9$ ohm. cm. at 10 kv;

(b) selecting particles of refractory material coated with organic binder so that the coated particles have an electrical resistivity of at least $10^{10}$ kv;

(c) tribo-electrically charging the coated particles;

(d) grounding the substrate and coating the surface of the substrate to be contacted with molten metal with the charged particles so as to provide the surface of the substrate with a coherent layer of said particles; and (e) thereafter casting the molten metal against said coated substrate.

2. A method according to claim 1 wherein the refractory material is zircon, graphite, silica, chromite or alumina.

3. A method according to claim 2 wherein the organic binder used in (b) is an epoxy resin, a polyester resin, a polyurethane resin, or a vegetable, mineral, animal or synthetic wax.

4. A method according to claim 3 wherein the organic binder in (b) constitutes up to 10% by weight of the coated particles.

5. In a method of casting molten metal using a foundry sand mould or core substrate for the cast molten metal, the improvement which comprises:

(a) preparing a mould or core substrate from sand and binder so that the substrate has a resistivity of less than $10^9$ ohm. cm. at 10 kv;

(b) tribo-electrically charging particles of refractory material coated with an organic binder, said coated particles having an electrical resistivity of at least $10^{10}$ kv;

(c) grounding the substrate and coating the surface of the substrate to be contacted with molten metal with the charged particles so as to provide the surface of the substrate with a coherent layer of said particles; and (d) thereafter casting the molten metal against said coated substrate.

* * * * *